United States Patent [19]

Macnab

[11] 4,441,585

[45] Apr. 10, 1984

[54] LIFT MAST ASSEMBLY

[75] Inventor: John E. Macnab, Dallas, Oreg.

[73] Assignee: Towmotor Corporation, Mentor, Ohio

[21] Appl. No.: 375,114

[22] PCT Filed: Mar. 22, 1982

[86] PCT No.: PCT/US82/00354

§ 371 Date: Mar. 22, 1982

§ 102(e) Date: Mar. 22, 1982

[87] PCT Pub. No.: WO83/03406

PCT Pub. Date: Oct. 13, 1983

[51] Int. Cl.[3] ..... B66B 7/02

[52] U.S. Cl. ..... 187/95; 187/9 E; 308/3 B

[58] Field of Search ..... 187/9 R, 9 E, 95, 6, 187/3; 308/3 R, 3 B, 3 C; 182/62.5, 141, 63; 52/118, 111, 117, 632; 414/628, 629, 630, 631

[56] References Cited

U.S. PATENT DOCUMENTS

| | | | |
|---|---|---|---|
| 2,456,320 | 12/1948 | Repte | 414/630 |
| 3,127,956 | 4/1964 | Hosbein et al. | 187/9 |
| 4,030,568 | 6/1977 | Heinold | 187/9 |
| 4,219,302 | 8/1980 | Leskovec | 414/635 |
| 4,238,004 | 12/1980 | Olson | 187/9 E |

*Primary Examiner*—Joseph J. Rolla
*Assistant Examiner*—Kenneth Noland
*Attorney, Agent, or Firm*—Alan J. Hickman

[57] ABSTRACT

This invention relates to a lift mast assembly (10) preferably for a vehicle (34) which eliminates the problems of reduced visibility, reduced load carrying capacity for a given vehicle size and weight. The lift mast assembly has a fixed upright assembly (12) having first and second spaced apart fixed uprights (16,18), a movable upright assembly (14) having first and second movable spaced apart uprights (24,26) and a first and second lift jack. The movable upright assembly (14) is mounted on and between the fixed upright assembly (12) and elevationally movable relative thereto. The first lift jack (60) is mounted on the first fixed upright (16) and positioned between the first fixed and first movable uprights (16,24) and the second lift jack (62) is mounted on the second fixed upright (18) and positioned between the second fixed and second movable uprights (18,26). Therefore, the lift mast asembly improves the visibility, increases the load carrying capacity, maximizes lift heights and reduces lift mast size and weight. The lift mast assembly is particularly useful in a lift truck.

23 Claims, 4 Drawing Figures

LIFT MAST ASSEMBLY

DESCRIPTION

1. Technical Field

This invention relates to a lift mast assembly and more particularly to a lift mast assembly having a moveable upright mounted on a fixed upright and elevationally extensibly movable relative thereto and a lift jack mounted on said lift mast assembly at a location between the fixed and movable uprights.

2. Background Art

Lift mast assemblies for use on a vehicle such as a lift truck are well known in the art. Such lift masts typically have a fixed pair of spaced apart uprights which are pivotally mounted on the lift truck and a movable pair of spaced apart uprights mounted on the fixed pair of uprights and elevationally extensibly movable relative thereto and a carriage mounted on the movable uprights and elevationally movable relative to the movable uprights. A lift jack is operatively connected between the fixed and movable uprights and carriage for effecting selective elevational movement of the movable uprights and the carriage.

In the past the lift jack was mounted on the lift mast at a centered location between the fixed pair of uprights which reduced the lift truck operator's field of visibility making accurate handling of material quite difficult. Further, the addition of lift chains and sheaves which are associated with the lift cylinder reduced the visibility to a greater degree.

Recent attempts have been made by industry to improve the operator's visibility and thereby improve efficiency and accuracy of operation. These attempts primarily consisted of locating the lift cylinder(s) outboard, behind, or in front of the uprights which would remove the obstruction caused by the cylinder from the center of the mast. Examples of these cylinder locations are shown in U.S. Pat. Nos. 3,127,956 dated Apr. 7, 1964 to H. W. Hosbein et al; 4,030 ,568 dated June 21, 1977 to Lloyd K. Heinold and U.S. Pat. No. 4,219,302 dated Aug. 26, 1980 to Edward V. Leskovec. Although these solutions have improved the visibility they have not totally solved this or related problems. In mast assemblies where the lift jacks are mounted behind the uprights it is necessary to locate the mast a greater distance from its mounting on the lift truck to provide clearance between the cylinders and the lift truck and therefore the load moment characteristic of the vehicle is changed which reduces the load carrying capacity of the machine. Likewise, placing the lift jacks in front of the uprights requires the load engaging carriage to be moved further away from the uprights of the lift mast thereby moving the load engaging carriage and a load to be supported thereon further away from the vehicle which also changes the load moment relationship which results in reduced lift capacity of the vehicle. Placement of the lift cylinders outboard of the uprights of the lift mast requires the uprights located adjacent one side of the vehicle to be moved inward and closer to the uprights located adjacent the other side of the vehicle as they are preferably located between the vehicle wheels which are at a fixed maximum width. Therefore, the mast uprights are now closer together which reduces the space provided between the uprights resulting in reduction in the operator's visibility. Attempts have been made to minimize this problem by reducing the length of the lift cylinders and locating them outboard of the outer fixed uprights and over the wheels. This, however, reduces the overall lift height of the lift mast assembly for a given upright length due to the reduction and stroke of the lift cylinders.

Often the lift jacks for the lift mast are nested between the inner or movable uprights. When a pair of lift cylinders are utilized they are each normally located closely adjacent a respective one of the movable uprights. Such an arrangement is shown in U.S. Pat. No. 2,456,320 dated Dec. 14, 1948 to E. P. Repke.

Lift chain and sheave arrangements are usually provided to connect the carriage and/or lift mast assembly to the lift jacks to effect elevational movement of the uprights and/or the carriage in response to movement of the lift jack. It is also advantageous to place the chain and sheave assemblies at locations wherein the visibility past the mast is maximized. An example of this is shown in U.S. Pat. No. 4,238,004 dated Dec. 9, 1980 to Harlan D. Olson. This patent shows the chain being nested between the fixed and movable uprights in a complicated manner.

Therefore, it would be advantageous to provide a lift mast assembly wherein the lift cylinders and chain and sheave arrangement are positioned at a location wherein the obstruction caused by the lift jack, chain and sheave arrangement, and the uprights, (both fixed and movable) are at a minimum. Further, it would be advantageous to keep the lift mast assembly as close to the vehicle as possible so that the load moment about the center of gravity of the vehicle is kept at a minimum thereby increasing or maximizing the load carrying capacity for a given vehicle size and weight. Additionally, it would be advantageous to provide fixed and movable uprights and bearing assemblies associated therewith which requires less space than the conventional fixed and movable upright and bearing assemblies and thereby further improve the operator's visibility through a reduction in bulk.

The present invention is directed to overcoming one or more of the problems as set forth above.

DISCLOSURE OF THE INVENTION

In one aspect of an embodiment of the present invention, a lift mast assembly having fixed and movable uprights and a lift jack is provided. A bearing arrangement is provided between the fixed and movable uprights for guiding the movable upright along the fixed upright and maintaining the movable upright at preselected minimum distance spaced from the fixed upright and providing space between the fixed and movable upright for permitting the lift jack to be mounted therebetween.

BEST MODE FOR CARRYING OUT THE INVENTION

Figure 1:
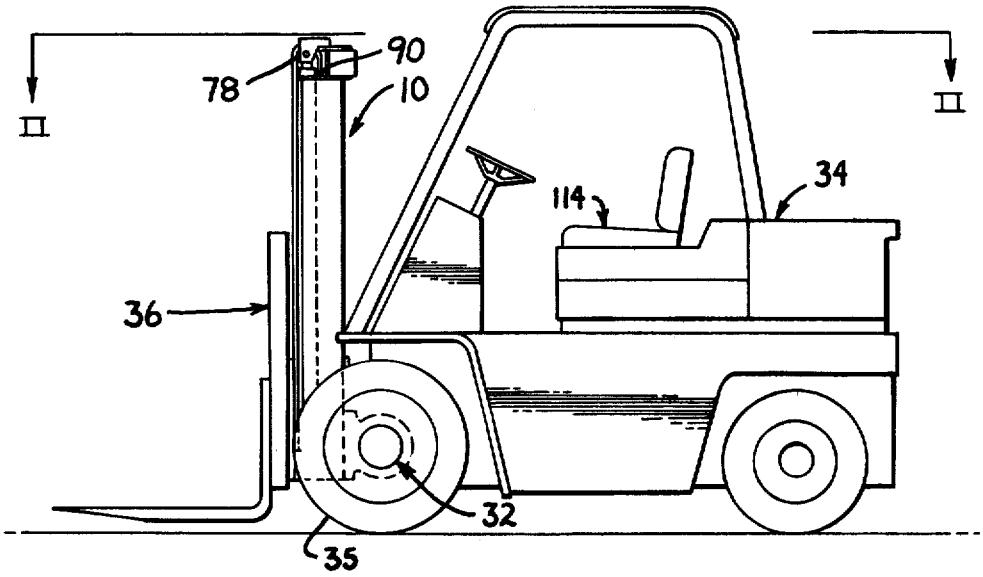
FIG. 1 is a diagrammatic side elevational view of a lift truck having a lift mast assembly of the present invention mounted thereon.

Referring to the drawings, a lift mast assembly 10 has a fixed upright assembly 12 and a movable upright assembly 14. The fixed upright assembly 12 has a first upright 16 and a second upright 18. These first and second fixed uprights 16 and 18 are interconnected to one another by upper and lower tie structure assemblies 20 and 22 which maintains the fixed uprights 16 and 18 a preselected spaced apart distance one from the other and forms a rigid structure with these uprights.

The movable upright assembly 14 has a first and second upright 24 and 26. Preferably the first and second movable uprights are interconnected by upper and lower tie structure assemblies 28 and 30. These upper and lower tie assemblies maintain the first and second movable uprights a preselected spaced apart distance and form a rigid structure with these uprights. The movable upright assembly 14 is mounted on and between the fixed upright assembly 12 and elevationally extensible relative thereto. The fixed upright assembly 12 is pivotly mounted on one end portion 32 of a lift truck 34 having a pair of spaced front wheels 35 in any suitable well known applicable manner.

A carriage assembly 36 of a type well known in the industry is mounted on the movable upright assembly 14 and elevationally positionable relative to the movable upright assembly. Preferably the carriage has an upper pair of guide rollers 38 and a lower pair of guide rollers 40 mounted thereon. One roller of each of the upper and lower pair is engageable with the first movable upright 26 and the other rollers of each of the upper and lower pair is engageable with the second movable upright 24. Although carriage rollers have specifically been taught in this preferred embodiment it is to be understood that other equivalents such as slider bearing blocks, strips, and the like which are known in the art are suitable substitutes.

The first and second fixed uprights 16 and 18 and the first and second movable uprights 24,26 each have a substantially rectangular elongate shaped web 42 having first and second sides 44 and 46 and a surface 47. The surface 47 of the first fixed and first movable uprights 16 and 24 face one another and the surface 47 of the second fixed and movable uprights 18 and 26 face one another. Surface 47 of the first fixed and first movable uprights 16 and 24 are maintained a predetermined minimum distance apart by a first upper and first lower bearing assembly 48 and 50 and the surface 48 of the second fixed and movable uprights 18 and 26 are maintained a preselected minimum distance apart by a second upper and second lower bearing assembly 52 and 54. It is to be noted that the upper bearing assemblies 48 and 52 are structurally identical but reversed and the lower bearing assemblies 50 and 54 are structurally identical but reversed. The first 16 and second 18 fixed uprights and the first 24 and second 26 movable uprights each have an upper and a lower end portion 56 and 58. The first upper bearing assembly 48 is connected to the upper end portion 56 of the first fixed upright 16 and the second upper bearing assembly 52 is connected to the upper end portion 56 of the second fixed upright 18. The first lower bearing assembly 50 is connected to the lower end portion 58 of the first movable upright 24 and the second lower bearing assembly 54 is connected to the lower end portion 58 of the second movable upright 26. It is to be noted that although the lower bearing assemblies 50 and 54 have been described as being connected to the lower end portion of the first and second movable uprights 24 and 26, respectively, connection of these lower bearing assemblies 50 and 54 to the lower end portion of the first and second fixed uprights 16 and 18, respectively, should be considered an equivalent alternative. The upper and lower bearing assemblies 48, 52, 50 and 54 and their relationship to the lift mast assemblies and the uprights will be dealt with in greater detail in subsequent discussion.

Figure 4:
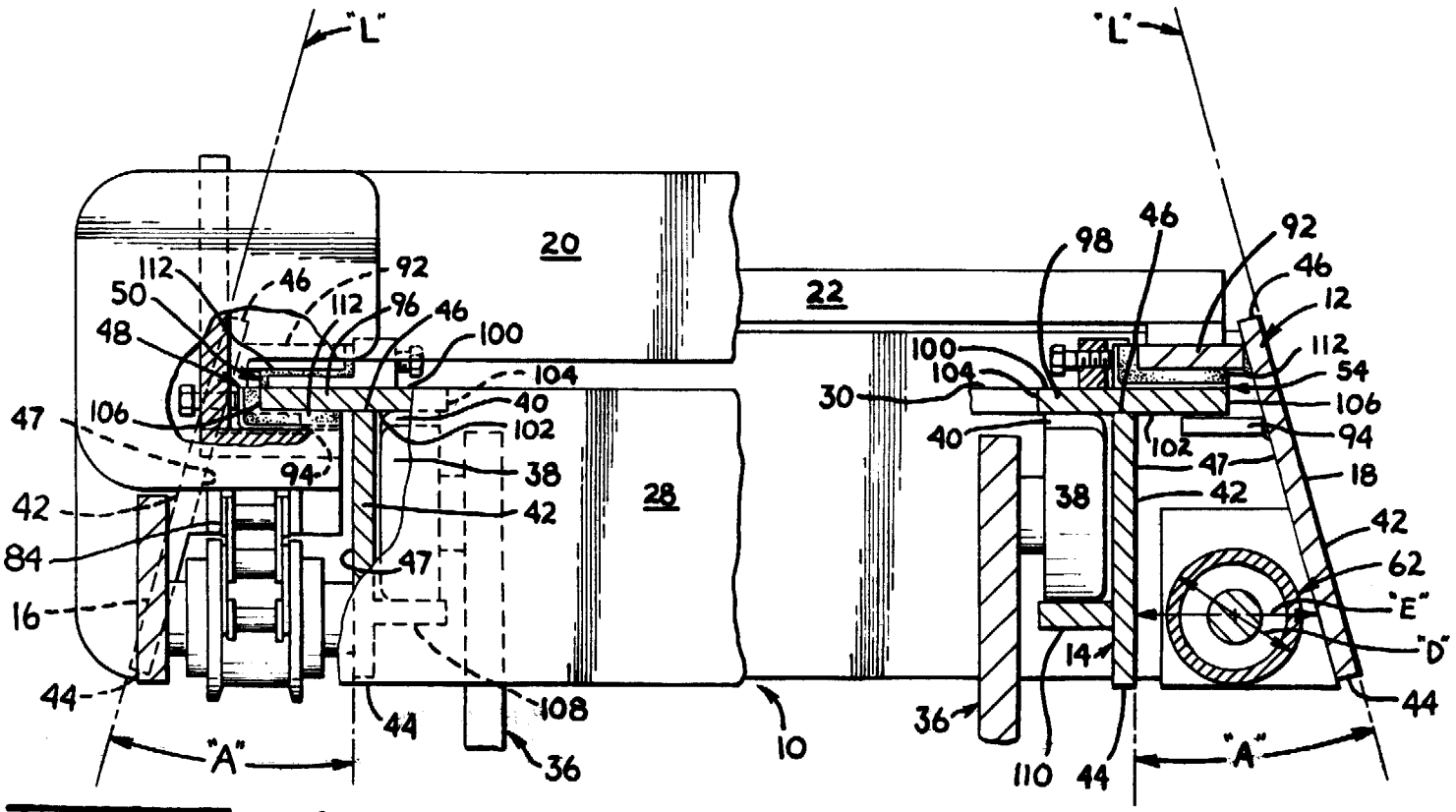
FIG. 4 is a diagrammatic sectional view of the lift mast assembly taken along lines IV—IV of FIG. 3 with portions of the lift mast assembly broken out to show more clearly certain components and relationships.

First and second lift jack 60 and 62 each have a tubular cylinder 64 and a piston rod 66 slideably disposed in the tubular cylinder. The cylinders 64 each have a lower end 68 and the piston rods 66 each have an upper end portion 70. The first lift jack 60 is mounted on one of the first fixed 16 and first movable 24 uprights and connected to the other of the first fixed 16 and first movable 24 uprights. The second lift jack 62 is mounted on one of the second fixed 18 and second movable 26 uprights and connected to the other of the second fixed 18 and second movable uprights 26. Preferably the first lift jack 60 is mounted on the first fixed upright 16 at its lower end portion 58 and the upper end portion 70 of its piston rod 66 is connected to the first movable upright 24. Similarly the second lift jack 62 is mounted on the second fixed upright 18 at its lower end portion 58 and the upper end portion 70 of the second lift jacks 62 piston rod 66 is connected to the second movable upright 26. As best seen in FIG. 4, the first lift jack 60 is positioned between the web 42 of the first fixed upright 16 and the web 42 of the first movable upright 24 and the second lift jack 62 is positioned between the web 42 of the second fixed upright 18 and the web 42 of the second movable upright 26. Additionally, the first lift jack 60 is preferably located between the first side 44 and the second side 46 of the web 42 of either one or both of the first fixed 16 and first movable 24 uprights and the second lift jack 62 is preferably located between the first and second sides 44 and 46 of the web 42 of either or both the second fixed and second movable uprights 18 and 26. It is to be noted that when the lift jacks are positioned in this nested manner with respect to their adjacent uprights that the uprights will shield the lift jacks from contact with objects so that damage will be prevented and the life of the lift jacks themselves will be extended.

Figure 3:
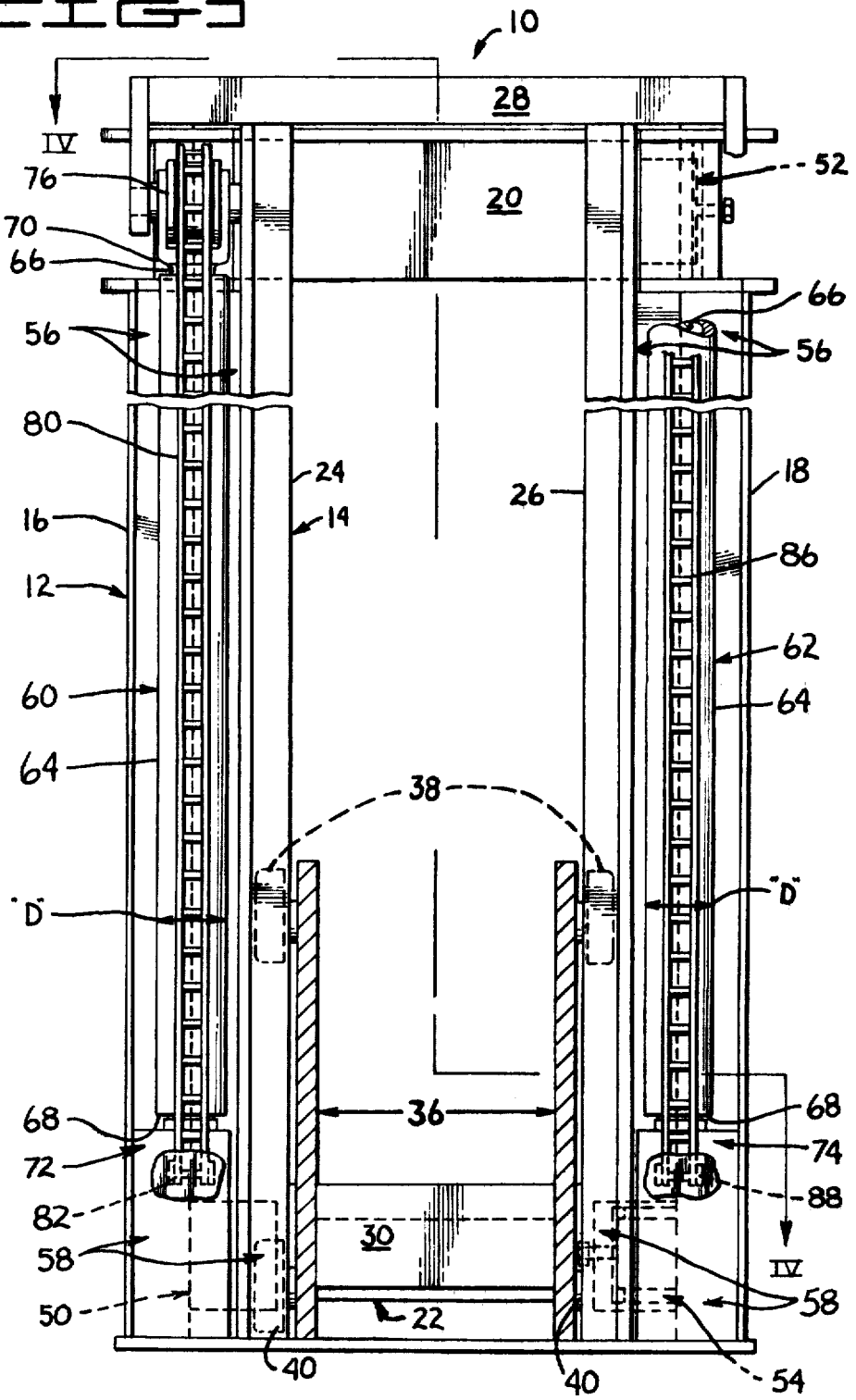
FIG. 3 is a diagrammatic sectional view taken along lines III—III of FIG. 2 showing the fixed and movable uprights, lift jacks, and bearing assemblies of the present invention.

As shown in the drawings and particularly the drawings of FIGS. 3 and 4, a first bracket assembly 72 is provided for mounting the first lift jack 60 on the first fixed upright 16 and a second bracket assembly 74 is provided for mounting the second lift jack 62 on the second fixed upright 18. The first bracket 72 is preferably connected to the web 42 of the first fixed upright 16 and extends a preselected distance in a direction from the surface 47 toward the web 42 of the first 24 and second fixed 18 upright. The second bracket assembly similarly, is connected to web 42 of the second fixed upright 18 and extends a preselected distance in a direction from the surface 47 toward the web 42 of the second movable 26 and first fixed 16 upright. It is to be noted that although the brackets were described as being two separate members it is to be understood that a single structure connected to the web 42 of both fixed uprights which extends transversely between these fixed uprights would be a suitable equivalent.

The lower end 68 of cylinder 64 of the first lift jack 60 is connected to the first bracket assembly 72 in any conventional suitable manner, for example such as by a pin, bolt, or ball joint and the lower end 68 of cylinder 64 of the second lift jack 62 is connected to the second bracket assembly 74 in a like manner. Preferably this connection will permit a limited amount of pivotable movement of each of the cylinders about their respective bracket connections.

A first sheave 76 is rotatably connected to the upper end portion 70 of piston rod 66 of the first lift jack and in a like manner a second sheave 78 is rotatably connected to the upper end portion 70 of piston rod 66 of the second lift jack 62. A first flexible tension member 80 having a first and second end 82 and 84 is trained over the first sheave and connected at the first end to the carriage assembly 36 and at the second end to the fixed upright assembly. It is to be noted that the first sheave and first flexible tension members are at least positioned between the webs 42 of the first fixed 16 and first movable 24 uprights. A second flexible tension member 86 (FIG. 1) having a first end 88 and a second end 90 is trained over the second sheave 78 and connected at the first end 88 to the carriage assembly 36 and at the second end 90 to the fixed upright assembly 12. It is to be noted that the second sheave 78 and second flexible tension member are at least partially located between the webs 42 of the second fixed 18 and second movable 26 uprights with the moveable uprights in the lowered position.

First fixed upright 16 and second fixed upright 18 each have a first 92 and second 94 rear flange mounted thereon. The first rear flanges 92 are each positioned on their respective fixed uprights 16 and 18 a preselected distance from the second side 46 of their respective webs 42 and the second rear flanges 94 are positioned on their respective fixed uprights 16 and 18 a preselected distance from the second side 46 of their respective webs 42. The distance between the second side 46 and its adjacent first rear flange 92 being smaller in magnitude than the distance between the adjacent second rear flange and the second side. The first and second rear flanges 92,94 are preferably elongate rectangular members and are mounted on their respective fixed uprights inwardly thereof so that the first and second rear flanges 92 and 94 of the first fixed upright and the first and second rear flange 92 and 94 of the second fixed upright 18 face one another. Preferably, the first and second rear flanges are mounted on the surface 47 of the web 42 of their respective first and second fixed uprights 16 and 18. Each of the first and second rear flanges 92 and 94 of the first fixed upright 16 are substantially parallel along their length and the first and second rear flanges 92 and 94 of the second fixed upright 18 are parallel along their length.

A first movable upright rear flange 96 and a second movable upright rear flange 98 each have a first and second surface 100 and 102 and a first and second side 104 and 106. The first movable upright rear flange 96 is connected to the second side 46 of the web 42 of the first movable upright 24 and the second movable upright rear flange 98 is connected to the second side 46 of the web 42 of the second movable upright 26. The first and second movable upright rear flanges are preferably elongate rectangular shaped members which extend the full length of the adjacent web 42.

A first movable upright front flange 108 and a second movable upright front flange 110 are connected to the first movable upright 24 and second movable upright 26, respectively. Specifically, the first movable upright front flange 108 is a substantially elongate rectangular member connected to the web 42 of the first movable upright 24 at a preselected distance spaced from the first movable upright rear flange 96. Similarly, the second movable upright front flange 110 is an elongate rectangular member and is connected to the web 42 of the second movable upright 26 at a preselected distance spaced from the second movable upright rear flange 98. The first and second movable upright front flanges 108 and 110 are oriented inwardly of their respective uprights and in a facing relationship one with the other and parallel to their respectively adjacent rear flanges 96,98. The first and second upper and lower bearing assemblies 48, 52, 50, and 54 each include a nonmetallic plastic bearing block 112 which is slideably engaged with one of the fixed and movable uprights 16, 18, 24, and 26. Preferably, the bearing blocks 112 of the first and second upper bearing assemblies 48 and 52 are of an L-shaped configuration and engageable with the first surface 100 and second side 106 of their respectively adjacent movable uprights 24 and 26 and the bearing blocks 112 of the lower bearing assemblies 50 and 54 are substantially L-shaped in configuration and engageable with their respectively adjacent first and second fixed upright rear flanges 92.

Referring particularly to FIGS. 3 and 4, the cylinders 64 of each of the first and second lift jacks 60 and 62 have a preselected diameter "D" and the distance "E" between the web of the first fixed upright 16 and first movable upright is greater in magnitude at the cylinder mounted location than the diameter "D" of the first cylinder and the distance "E" between the web of the second fixed and second movable uprights 18 and 26 at the cylinder mounted location being greater in magnitude than the diameter "D" of the cylinder. Preferably, the distance between these adjacent webs is only slightly greater than the cylinder diameter so as to reduce the cross-sectional width and thereby minimize the bulk of obstruction. Likewise, the first and second flexible tension members 80 and 86 are nested between the respective webs 42 of the adjacent pairs of fixed and movable uprights and thereby improving the operator's visibility.

Figure 2:
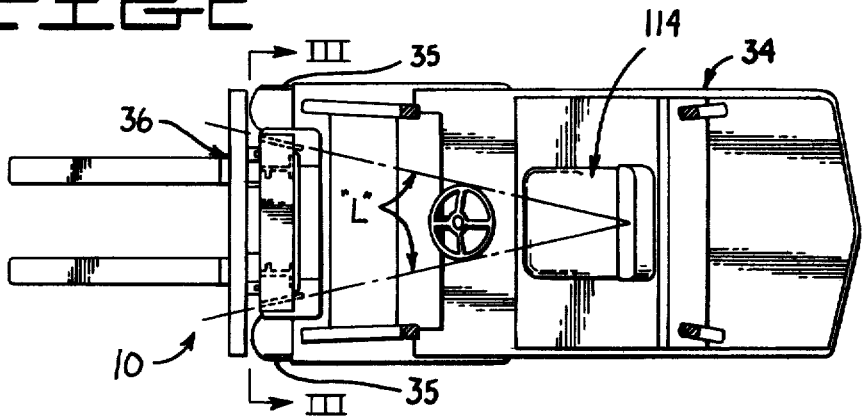
FIG. 2 is a diagrammatic top elevational view of the lift mast assembly and the lift truck as viewed from lines II—II of FIG. 1.

With reference to FIG. 3, the web 42 of first and second fixed uprights 16 and 18 are preferably oriented at a predetermined angle "A" relative to the webs 42 of their respectively adjacent movable uprights 24 and 26. The angle of each of the fixed upright webs is determined by the location of an operator's station 114 and the lines of sight "L" (see FIG. 2) from the operator's station for a given operator norm. Preferably the angle of each of the webs 42 of the fixed uprights 16 and 18 are the same relative to the web 42 of their respectively adjacent movable upright 24 and 26 and each angle "A" is equal to one half the included angle established by the lines "L" of sight. In other words, the web 42 of the first fixed upright 16 is spaced a preselected first distance from the web 42 of the first movable upright 24 at the web second side 46 and a second preselected distance from the web 42 of the first movable upright at the webs first side 44. Likewise the web 42 of the second fixed upright 18 is spaced an equal first preselected distance from the web 42 of the second movable upright 26 at the web's second side and the same second preselected distance from the web 42 of the second movable upright 26 at the web's first side 44. Preferably this first preselected distance is smaller in magnitude than the second preselected distance.

INDUSTRIAL APPLICABILITY

In operation with reference to the drawings, elevational movement of the movable upright assembly 14 along the fixed upright assembly 12 and elevational movement of the carriage along the guideways provided by the front and rear flanges 96, 98, 108, and 110 for the carriage rollers 38,40 is achieved through extension and retraction of the lift jacks 60 and 62. Extension of the rods 66 will cause extension of the movable upright assembly 14 through the previously discussed movable upright and rod connection and elevational movement of the carriage 36 relative to the movable upright assembly 14 is achieved through the connection of the sheaves 76 and 78 and the first and second flexible tension members 80 and 86.

Since the first lift jack 60 and associated first sheave 76 and first flexible tension member 80 are nested between the webs 42 of the first fixed 16 and first movable upright 24 and the second lift jack 62 and associated second sheave 78 and second flexible tension member 86 are nested between the webs 42 of the second fixed 18 and second movable 26 uprights the obstruction relative to the line of sight of the vehicle operator is minimized.

Since a pair of lift jacks 60 and 62 are provided, as compared to a single lift jack, the diameter of cylinder 66 is substantially reduced which permits the webs 42 of the adjacent fixed and movable uprights to be spaced a closer distance apart than previously permitted. Further utilizing the bearing assemblies 48, 50, 52 and 54 as previously discussed reduces the distance required between the adjacent fixed and movable uprights which permits this total overall reduction in the mast obstruction. Finally, by placing the webs 42 of the fixed uprights 16 and 18 at an angle relative to the webs 42 of their adjacent movable uprights 24 and 26, respectively, further enhances the operator's visibility is further enhanced as the angle at which the webs 42 are placed is parallel to the line of sight of the operator.

Locating the lift jacks 60 and 62 between the first and second sides of the webs 42 of either one of the respectively adjacent fixed and movable uprights 16, 18, 24 and 26 improves the load moment constant of the vehicle and thereby maximizes the load carrying capacity thereof for a given vehicle size and weight.

Finally, due to the compactness of the mast assembly 10, the mast assembly may be located between the front wheels 35 without reducing the visibility, shortening the lift jacks 60,62, or reducing overall lift height.

Other aspects, objects and advantages of the invention can be readily obtained from a study of the drawings, disclosure and appended claims.

I claim:

1. A lift mast assembly (10) comprising:

a first movable elongate upright (24) and a first fixed elongate upright (16), said first movable upright (24) having a web (42) and a flange (96), and said first fixed upright (16) having a web (42) and a flange (92), said first movable upright (24) being mounted on the first fixed upright (16) and elevationally extensibly movable relative to the first fixed upright, said first movable upright (24) flange (96) being connected to the first movable upright (24) web (42) and projecting therefrom in a direction toward the web (42) of the first fixed upright (16), and said first fixed upright (16) flange (92) being connected to said first fixed upright (16) web (42) and projecting therefrom in a direction toward the web (42) of the first movable upright (24);

bearing means (48,50) for guiding said movable upright (24) for movement along said first fixed upright (16) and maintaining the web (42) of said first movable upright (24) a preselected minimum distance ("E") spaced apart from the web (42) of the first fixed upright (16) at a preselected location spaced from the first movable and first fixed upright flanges (96,92); said bearing means (48,50) being connected to said first fixed and first movable uprights (16,24) and engageable with said flanges (92,96);

a first lift jack (60) mounted on one of said first fixed and first movable uprights (16,24), said first lift jack (60) being nested between the webs (42) of the first fixed and first movable uprights (16,24) at said preselected location.

2. The lift mast assembly (10) as set forth in claim 1 wherein said first fixed (16) and first movable (24) upright webs each have first (44) and second (46) sides, said preselected location being between the first and second sides (44,46) of the webs (42) of the first fixed and first movable uprights (16,24).

3. The lift mast assembly (10) as set forth in claim 2 wherein said first lift jack (60) includes;

a tubular cylinder (64) having a preselected diameter ("D"), and a lower end (68), and a piston rod (66) slideably disposed in said cylinder (64), said cylinder (64) being mounted on said first fixed upright (16) at said preselected location and closely adjacent the first side (44) of said first fixed upright (16) web (42), said cylinder diameter ("D") being smaller in magnitude than the distance ("E") between the web (42) of the first fixed upright (16) and the web (42) of the first movable upright (24) at said preselected location of the first lift jack mounting.

4. The lift mast assembly (10) as set forth in claim 3 wherein said first fixed upright (16) has a lower end portion (58) and includes;

a first bracket assembly (72) connected to the web (42) of the first fixed upright (16) at the lower end portion (58) thereon and extends in a direction toward the web (42) of the first movable upright (24), said lower end (28) of the cylinder (64) being connected to said first bracket (72).

5. The lift mast assembly (10) as set forth in claim 3 wherein said piston rod (66) has an upper end portion (70) connected to said first movable upright (24).

6. The lift mast assembly (10) as set forth in claim 5 including:

a load engaging carriage assembly (36) mounted on said first movable upright (24) and elevationally movable relative thereto;

a first sheave (76) rotatably mounted on the upper end portion (56) of said rod (66);

a first flexible tension member (80) having a first and second end (82,84) and being trained over said sheave (76), said first flexible tension member (80) being connected at the first end (82) to said carriage (36) and at the second end (84) to said first fixed upright (16).

7. The lift mast assembly (10) as set forth in claim 2 wherein said first fixed and first movable uprights (16,24) each have an upper and lower end portion (56,58) and said bearing means (48,50) includes:

a first upper bearing assembly (48) having a bearing block (112) and being connected to said first fixed upright (16) at the upper end portion (56) thereon, said first upper bearing assembly (48) bearing block (112) being slideably engaged with said movable upright; and a first lower bearing assembly (50) having a bearing block (112) and being connected to one of said first fixed and first movable uprights (16,24) at the lower end portion (58) thereon, said bearing block (112) of the lower bearing assembly (50) being slideably engaged with the other one of said first fixed and first movable uprights (16,24).

8. The lift mast assembly (10) as set forth in claim 7 wherein said first lower bearing assembly (50) is connected to said first movable upright (24).

9. A lift mast assembly (10); comprising:

a first movable elongate upright (24) and a first fixed elongate upright (16) each having a web (42) and upper and lower end portions (56,58), said webs (42) each having first (44) and second (46) sides, said first movable upright (24) being mounted on the first fixed upright (16) and elevationally extensibly movable relative thereto;

said first movable upright (24) having a first rear flange (96), said first rear flange (96) having first and second surfaces (100,102) and first and second sides (104,106), said first rear flange (96) being connected to said second side (46) of the web (42) of said first movable upright (24);

bearing means (48,50) for guiding said movable upright (24) for movement along said first fixed upright (16) and maintaining said first movable upright (24) a preselected minimum distance ("E") spaced from the first fixed upright (16) at a preselected location relative thereto, said preselected distance ("E") being a distance between the webs (42) of the first fixed (16) and first movable (24) uprights at said preselected location, said bearing means (48,50) being connected to said first fixed and first movable uprights (16,24);

said bearing means having a first upper bearing assembly (48) having a bearing block (112) ahd being connected to said first fixed upright (16) at the upper end portion (56), and a first lower bearing assembly (50) having a bearing block (112) and being connected to said first movable upright (24) at the lower end portion, said bearing block (112) of the first upper bearing assembly (48) being slidably engaged with said first movable upright (24) and said bearing block (112) of the first lower bearing assembly (50) being slidably engaged with the first fixed upright (16), said first upper bearing assembly (48) being engageable with the second side (106) and second surface (102) of the first rear flange (96); and a first lift jack (60) being mounted on one of said first fixed and first movable uprights (16,24) at said preselected location and positioned between the first fixed upright (116) and the first movable upright (24).

10. A lift mast assembly 9; comprising:

a first movable elongate upright (24) and a first fixed elongate upright (16), said first movable upright (24) being mounted on the first fixed upright (16) and elevationally extensibly movable relative thereto, said first fixed (16) and first movable (24) uprights each having a web (42), said webs (42) each having first (44) and second (46) sides and each being substantially rectangular elongate members, said web (42) of the first fixed upright (16) being oriented at a preselected angle ("A") relative to said movable upright (24);

bearing means (48,50) for guiding said movable upright (24) for movement along said first fixed upright (16) and maintaining the said first movable upright (24) a preselected minimum distance ("E") spaced from the first fixed upright (16) at a preselected location relative thereto, said preselected distance ("E") being a distance between the webs (42) of the first fixed (16) and first movable (24) uprights at said preselected location, said bearing means (48,50) being connected to said first fixed and first movable uprights (16,24); and a first lift jack (60) mounted on one of said first fixed and first movable uprights (16,24) at said preselected location and positioned between the first fixed upright (16) and the first movable upright (24).

11. A lift mast assembly (10); comprising:

a first movable elongate upright (24) and a first fixed elongate upright (16), said first movable upright (24) being mounted on the first fixed upright (16) and elevationally extensibly movable relative thereto, said first fixed and first movable uprights (16,24) each having a web (42) having first (44) and second (46) sides, and webs (42) each being substantially elongate rectangular members and each having a surface (47) terminating at said first and second sides (44,46), said surface (47) of the web (42) of the first fixed upright (16), at said first side (44), being positioned a preselected first distance from said surface (47) of the web (42) of the first movable upright (24), and said surface of the web (42) of the first fixed upright (16), at said second side (46), being positioned a preselected second distance from said surface (47) of the web (42) of the first movable upright (24), said second distance being smaller in magnitude than said first distance;

bearing means (48,50) for guiding said movable upright (24) for movement along said first fixed upright (16) and maintaining the said first movable upright (24) a preselected minimum distance ("E") spaced from the first fixed upright (16) at a preselected location relative thereto, said preselected distance ("E") being a distance between the webs (42) of the first fixed (16) and first movable (24) uprights at preselected location, said bearing means (48,50) being connected to said first fixed and first movable uprights (16,24); and a first lift jack (60) mounted on one of said first fixed and first movable uprights (16,24) at said preselected location between the first fixed upright (16) and the first movable upright (24).

12. A lift mast assembly (10) comprising:

first and second spaced apart sides;

a fixed upright assembly (12) having first and second fixed spaced apart uprights (16,18), said first and second fixed uprights (16,18) each having a web (42) and a flange (92) connected to each of said webs (42);

a movable upright assembly (14) having first and second movable spaced apart uprights (24,26), said first and second movable uprights (24,26) each having a web (42) and a flange (96,98) connected to each of said webs (42), said first and second movable uprights (24,26) being mounted on said first and second fixed uprights (16,18), respectively, and between said first and second fixed uprights (16,18), said movable upright assembly (14) being extensibly movable relative to the fixed upright assembly (12), said first fixed (16) and first movable (24) uprights being located at the first side of the lift mast assembly (10) and said second fixed (18) and second movable (26) uprights being located at the second side of the lift mast assembly (10);

bearing means (48,50,52,54) for guiding said movable upright assembly (14) for movement along said fixed upright assembly (12) and maintaining the web (42) of the first movable upright (24) a preselected minimum distance ("E") from the web (42) of the first fixed upright (16) at a preselected location spaced from the flanges (92,96) of the first fixed and first movable uprights (16,24) and the web (42) of the second movable upright (26) a preselected minimum distance ("E") from the web (42) of the second fixed upright (18) at a preselected location spaced from the flanges (92,98) of the second fixed and second movable uprights (18,26), said bearing means being engageable with said flanges (92,96,98); and first and second lift jacks (60,62), with first lift jack (60) being positioned on the first side of said lift mast assembly (10) at said preselected location between the webs (42) of the first fixed and first movable uprights (16,24), and said second lift jack (62) being positioned on the second side of said lift mast assembly (10) at said preselected location and between the webs (42) of the second fixed and second movable uprights (18,26), said first and second jacks (60,62) being connected to the first and second movable uprights (24,26), respectively.

13. The lift mast assembly (10) as set forth in claim 12, including;

a first and second bracket (72,74), said first bracket (72) being connected to said first fixed upright (16) and said second bracket (74) being connected to said second fixed upright (18); and said first lift jack (60) being mounted on said first bracket (72) and said second lift jack (62) being mounted on said second bracket (74).

14. The lift mast assembly (10) as set forth in claim 13 wherein said first and second fixed uprights (16,18) each have a lower end portion (58) and said first and second lift jacks (60,62) each have a cylinder (64) having a lower end (68) and a piston rod (64) slideably disposed in said cylinder (64);

said first bracket (72) being connected to the lower end portion (58) of the first fixed upright (16) and said second bracket (74) being connected to the lower end portion (58) of the second fixed upright (18); and said cylinder (64) of the first jack (60) being connected at the lower end (68) to said first bracket (72) and said cylinder (64) of the second jack (62) being connected at said lower end (68) to the second bracket (74).

15. The lift mast assembly (10) as set forth in claim 14 wherein said first lift jack (60) is located between the first and second sides (44,46) of the web (42) of the first fixed upright (16) and the second lift jack (62) is located between the first and second side (44,46) of the web (42) of the second fixed upright (18).

16. The lift mast assembly (10) as set forth in claim 14 wherein the piston rods (66) of the first and second jacks (60,62) each have an upper end portion (70), said upper end portion (70) of the rod (66) of the first jack (60) being connected to the first movable upright (24) and the upper end portion (70) of the rod (66) of the second jack (62) being connected to the second movable upright (26).

17. The lift mast assembly (10) as set forth in claim 16 including:

a carriage assembly (36) mounted on said movable upright assembly (14) and elevationally movable relative thereto;

a first and second sheave (76,78), said first sheave (76) being connected to the upper end portion (70) of the rod (66) of the first jack (60), said first sheave being located between the webs (42) of the first fixed and first movable uprights (16,24), and said second sheave assembly (78) being connected to the upper end portion (70) of the rod (66) of the second jack (62), said second sheave being located between the webs (42) of the second fixed and second movable uprights (18,26); and a first flexible tension member (80) having a first and second end (82,84) and a second flexible tension member (86) having a first and second end (88,90), said first tension member (80) being trained over the first sheave assembly (76) and said second tension member (86) being trained over the second sheave (78), said first ends (82,88) being connected to the carriage assembly (36) and said second ends (84,90) being connected to the fixed upright assembly (12).

18. The lift mast assembly (10) as set forth in claim 12 wherein said first and second fixed uprights (16,18) and said first and second movable uprights (24,26) each have an upper and lower end portion (56,58), and said bearing means (48,50,52,54) includes:

first and second upper bearing assemblies (48,52), said first upper bearing assembly (48) being mounted on the upper end portion (56) of the first fixed upright (16) and said second upper bearing assembly (52) being mounted on the upper end portion (56) of the second fixed upright (18), said first upper bearing assembly (48) being slideably engaged with the first movable upright (24) and said second upper bearing assembly (52) being slideably engaged with the second movable upright (26); and first and second lower bearing assemblies (50,54), said first lower bearing assembly (50) being mounted on the lower end portion (58) of one of said first fixed and first movable uprights (16,24) and engageable with the other of said first fixed and first movable uprights (16,24) and said second lower bearing assembly (54) being mounted on the lower end portion (58) of one of said second fixed and second movable uprights (18,26) and engageable with the other of said second fixed and second movable uprights (18,26).

19. The lift mast assembly (10) as set forth in claim 18 wherein the first lower bearing assembly (50) is mounted on the first movable upright (24) and the second lower bearing assembly (54) is mounted on the second movable upright (26).

20. The lift mast assembly (10) as set forth in claim 19 wherein said first and second upper and lower bearing assemblies (48,52,50,54) each have a bearing block (112)

slideably engaged with one of said fixed and movable upright assemblies (12,14).

21. A lift mast assembly (10); comprising:

a fixed upright assembly (12) having first and second fixed spaced apart uprights (16,18), said first and second fixed uprights (16,18) each having a web (42) and each of said webs (42) having first and second sides (44,46);

a movable upright assembly (14) having first and second movable spaced apart uprights (24,26), said first and second movable uprights (24,26) each having a web (42) and each of said webs (42) having first and second sides (44,46), said first and second movable uprights (24,26) being mounted on said first and second fixed uprights (16,18), respectively, and between said first and second fixed uprights (16,18), said movable upright assembly (14) being extensibly movable relative to the fixed upright assembly (12), said movable upright assembly (14) having first and second rear flanges (96,98) each having first and second surfaces (100,102) and first and second sides (104,106), said first rear flange (96) being connected to the second side (46) of the web (42) of the first movable upright (24) and said second rear flange (98) being connected to the second side (46) of the web (42) of the second movable upright (26), said first and second fixed uprights (16,18) and said first and second movable uprights (24,26) each having upper and lower end portions (56,58);

bearing means (48,50,52,54) for guiding said movable upright assembly (14) for movement along said fixed upright assembly (12) and maintaining the web (42) of the first movable upright (24) a preselected minimum distance ("E") from the web (42) of the first fixed upright (16) at a preselected location relative thereto, and maintaining the web (42) of the second movable upright (26) a preselected minimum distance ("E") from the web (42) of the second fixed upright (18) at a preselected location relative thereto;

said bearing means (48,50,52,54) having first and second upper bearing assemblies (48,52), said first upper bearing assembly (48) being mounted on the upper end portion (56) of the first fixed upright (16) and said second upper bearing assembly (52) being mounted on the upper end portion (56) of the second fixed upright (18), said first upper bearing assembly (48) being slidably engaged with the first movable upright (24) and said second upper bearing assembly (52) being slidably engaged with the second movable upright (26);

said bearing means (48,50,52,54) having first and second lower bearing assemblies (50,54), said first lower bearing assembly (50) being mounted on the lower end portion (58) of one of said first fixed and first movable uprights (16,24) and engageable with the other of said first fixed and first movable uprights (16,24), and said second lower bearing assembly (54) being mounted on the lower end portion (58) of one of said second fixed and second movable uprights (18,26) and engageable with the other of said second fixed and second movable uprights (18,26);

said first lower bearing assembly (50) being mounted on the first movable upright (24) and the second lower bearing assembly (54) being mounted on the second movable upright (26), said first and second upper and lower bearing assemblies (48,50,52,54) each have a bearing block (112) slidably engaged with one of said fixed and movable upright assemblies (12,14);

said bearing block (112) of the first upper bearing assembly (48) being engaged with the second side (106) and the second surface (102) of the first movable upright (24) rear flange (96) and said bearing block (112) of the second upper bearing assembly (52) being engaged with the second side (106) and second surface (102) of the second movable upright (26) rear flange (98); and first and second lift jacks (60,62), said first lift jack (60) being mounted on said first fixed upright (16) at said preselected location and between the webs (42) of the first fixed and first movable uprights (16,24) and said second lift jack (62) being mounted on said second fixed upright (18) at said preselected location and between the webs (42) of the second fixed and second movable uprights (18,26), said first and second jacks (60,62) being operatively connected to their respective first and second movable uprights (24,26).

22. A lift mast assembly (10); comprising:

a fixed upright assembly (12) having first and second fixed spaced apart uprights (16,18), said first and second fixed uprights (16,18) each having a web (42) and each of said webs (42) having first and second sides (44,46);

a movable upright assembly (14) having first and second movable spaced apart uprights (24,26), said first and second movable uprights (24,26) each having a web (42) and each of said webs (42) having a first and second side (44,46), said first and second movable uprights (24,26) being mounted on said first and second fixed uprights (16,18), respectively, and between said first and second fixed uprights (16,18), said movable upright assembly (14) being extensibly movable relative to the fixed upright assembly (12);

said webs (42) of the first and second fixed and movable uprights (16,18,24,26) being substantially rectangular elongate members and the web (42) of the first fixed upright (16) being oriented at a preselected angle ("A") relative to the web (42) of the first movable upright (24) and the web (42) of the second fixed upright (18) being oriented at a preselected angle ("A") relative to the web (42) of the second movable upright (26);

bearing means (48,50,52,54) for guiding said movable upright assembly (14) for movement along said fixed upright assembly (12) and maintaining the web (42) of the first movable upright (24) a preselected minimum distance ("E") from the web (42) of the first fixed upright (16) at a preselected location relative thereto, and maintaining the web (42) of the second movable upright (26) a preselected minimum distance ("E") from the web (42) of the second fixed upright (18) at a preselected location relative thereto;

first and second lift jacks (60,62), said first lift jack (60) being mounted on said first fixed upright (16) at said preselected location and between the webs (42) of the first fixed and first movable uprighs (16,24), and said second lift jack (62) being mounted on said second fixed upright (18) at said preselected location and between the webs (42) of the second fixed and second movable uprights (18,26), said first and second jacks (60,62) being operatively connected to their respective first and second movable uprights (24,26);

said first and second fixed uprights (16,18) each having a lower end portion (58), and said first and second lift jacks (60,62) each having a cylinder (64) having a lower end (68) and a piston rod (64) slidably disposed in said cylinder (64);

first and second brackets (72,74), said first bracket (72) being connected to the lower end portion (58) of the first fixed upright (16), and said second bracket (74) being connected to the lower end portion (58) of the second fixed upright (18); and said cylinder (64) of the first jack (60) being connected at the lower end (68) thereof to said first bracket (72), and said cylinder (64) of the second jack (62) being connected at said lower end (68) thereof to the second bracket (74).

23. The lift mast assembly (10) as set forth in claim 22 wherein said first and second lift jack (60,62) cylinders (64) each have a preselected diameter ("D"); and said distance ("E") between the web (42) of the first fixed and web (42) of the first movable upright (16,24) at the preselected location of the first jack mounting being greater in magnitude than the diameter ("D") of the first lift jack (60) cylinder (64) and said distance ("E") between the web (42) of the second fixed upright (18) and the web (42) of the second movable upright (26) being greater in magnitude than the diameter of said second lift jack (62) cylinder (64) at the preselected location of the second jack mounting.

* * * * *